US006186187B1

(12) United States Patent
Nakada

(10) Patent No.: US 6,186,187 B1
(45) Date of Patent: Feb. 13, 2001

(54) CLOTH MOVING TYPE PILE FORMING APPARATUS

(75) Inventor: Akihiko Nakada, Ishikawa-ken (JP)

(73) Assignee: Tsudakoma Kogyo Kabushiki Kaisha (JP)

( * ) Notice: Under 35 U.S.C. 154(b), the term of this patent shall be extended for 0 days.

(21) Appl. No.: 09/503,631

(22) Filed: Feb. 14, 2000

(30) Foreign Application Priority Data

May 6, 1999 (JP) ..... 11-125703

(51) Int. Cl.[7] ..... D03D 39/22
(52) U.S. Cl. ..... 139/25
(58) Field of Search ..... 139/252, 26

(56) References Cited

U.S. PATENT DOCUMENTS

| | | | |
|---|---|---|---|
| 4,569,373 | 2/1986 | Vogel | 139/25 |
| 5,058,628 | 10/1991 | Spiller et al. | 139/25 |
| 5,458,160 | 10/1995 | Geiger et al. | 139/25 |
| 5,518,037 | 5/1996 | Takahashi et al. | 139/25 |

FOREIGN PATENT DOCUMENTS

| | | |
|---|---|---|
| 22 25 604 | 7/1973 | (DE) . |
| 44 32 452 | 3/1995 | (DE) . |
| 0 518 809 | 12/1992 | (EP) . |
| 7-90750 * | 4/1995 | (JP) . |

* cited by examiner

*Primary Examiner*—Andy Falik
(74) *Attorney, Agent, or Firm*—Christensen O'Connor Johnson Kindness PLC

(57) ABSTRACT

A pile forming apparatus of the type where piles are formed in cloth through movement of the cloth between a first position wherein piles are formed and a second position wherein piles are not formed. The apparatus includes a driving mechanism operated in synchronism with rotation of the main shaft of a loom, a transmission mechanism, and a cloth moving device, wherein the motion of the driving mechanism is transmitted to the cloth moving member by the transmission mechanism. The transmission mechanism includes a pair of swing levers connected with each other by a connection body such that the connecting position therebetween is made variable. One of paired swing levers is driven by the driving mechanism and the other is coupled with the cloth moving member. The connecting position between at least one of paired swing levers and the connection body is changed from at least the first position corresponding to an effective lever length enabling piles to be formed, to the second position corresponding to the effective lever length unable to form any pile, or vice versa according to a weaving plan or design. The connection between the swing levers and the driving mechanism enable the driving mechanism to receive and withstand the load applied to the entire system.

5 Claims, 4 Drawing Sheets

CLOTH MOVING TYPE PILE FORMING APPARATUS

BACKGROUND OF THE INVENTION

1. Field of the Invention

The present invention relates to a pile forming apparatus of the cloth moving type, capable of moving at least cloth or woven fabrics in a terry loom.

2. Description of the Prior Art

A terry loom for weaving woven fabrics having piles such as a terry towel includes, in general, a pile forming apparatus which can vary the positional relation between a reed and a cloth fell, that is, the positional relation between a so-called fast pick position (first pick position) for forming pile by beating a weft toward the cloth fell (i.e. a beating position for beating the weft to bring it into contact with the cloth fell) and a so-called loose pick position (second pick position) for just moving wefts up to a position at a certain distance from the cloth fell (i.e. a half beating position for beating wefts to move them up to a position at a certain distance from the cloth fell).

As an example of the pile forming apparatus of this kind, U.S. Pat. No. 5,392,817 (Japanese Patent Application Public Disclosure (KOKAI) No. 5(1993)-156546) discloses a cloth moving type pile forming apparatus in which woven fabrics are moved with respect to a reed by means of a cloth moving member. In this apparatus as disclosed, the following system is employed for moving the woven fabrics. The first swing lever (a roller lever) is swung by a negative motion cam mechanism which is driven in synchronism with rotation of the main shaft of a loom. The swing motion of this first swing lever is then transmitted to a coupling hook detachably connected with the first swing lever, further transmitted to the second swing lever (driving lever) through a sliding ring connected with the above coupling hook, and finally transmitted to a woven fabric table as the cloth moving member by the second swing lever.

In the pile weaving operation according to the above prior art system, the first swing lever and the coupling hook are connected with each other, thereby moving the cloth moving member in the warp running direction (referred to as "front and back direction" hereinafter), from the fast pick position to the loose pick position or vice versa according to a weaving plan or design. With this, the cloth fell is moved from the fast pick position to the loose pick position or vice versa according to a weaving plan or design.

Contrary to this, in the weaving operation other than the pile weaving operation (for example ordinary cloth weaving, border weaving), the first swing lever is detached from the coupling hook, thereby holding the cloth moving member and the cloth fell in the fast pick position. With this, the pile length would be kept almost zero.

In the prior art system as described above, however, when the first swing lever and the coupling hook are detached from each other, it is required to additionally provide a stopper which can receive and stand a load imposed to the entire system, for instance, the load in the form of the tension applied to the warp and the woven fabric as well, the reaction force caused by the beating motion, and so forth. This results in enlargement in the scale of the apparatus.

Therefore, in the cloth moving type pile forming apparatus, it is desirable to make the scale of the apparatus as small as possible.

SUMMARY OF THE INVENTION

A cloth moving type pile forming apparatus according to the invention comprises: a driving mechanism driven in synchronism with the rotation of the main shaft of a loom; a cloth moving member for moving woven fabric with respect to a reed; a transmission mechanism having a pair of swing levers which are connected with each other by means of a connection body, the connecting position therebetween being made variable, one of the paired swing levers being driven by the driving mechanism and the other thereof being coupled with the cloth moving member; and a position change device capable of changing the connecting position between at least one of the paired swing levers and the connection body, from at least one first position corresponding to an effective lever length enabling piles to be formed, to a second position corresponding to the effective lever length being unable to form any pile, or vice versa according to a weaving plan or design.

In the pile weaving operation, the connecting position between at least one of the paired swing levers and the connection body is changed to the first position by means of a position change device and is held therein. With this, the swing motion of the one swing lever is transmitted to the other swing lever, the cloth moving member is changed from the fast pick position to the loose pick position or vice versa according to a weaving plan or design.

Contrary to this, in the weaving operation other than the pile weaving operation, the connecting position between at least one of the paired swing levers and the connection body is changed to the second position by means of the position change device and is held therein. With this, the swing motion of the one swing lever is hardly transmitted to the other swing lever, so that the cloth moving member is held in the fast pick position, thus no pile being formed.

According to the invention, even in the weaving operation other than the pile weaving operation, since a pair of swing levers are connected with each other while one of them are connected with the driving mechanism, a load imposed to the entire system, for instance, the load in the form of the tension applied to the warp and the woven fabric as well, the reaction force caused by the beating motion and so forth, is received by the driving mechanism so that there is no need to additionally provide such a stopper that was required in the prior art. Therefore, the apparatus is not enlarged in the scale.

The above position change device can change the connecting position between at least one of the paired swing levers and the connection body to one first position selected from a plurality of available first positions. With this, the pile length may be made variable. The driving mechanism may be provided with a cam mechanism, especially a positive motion cam mechanism.

One of paired swing levers includes a guide portion extending in one direction, the connection body is connected with the guide portion movably in the longitudinal direction of the guide portion and is also pivotally connected with the other of the paired swing levers, thereby connecting both of the paired swing levers together, and the position change device includes a mechanism for moving the connection body which moves the connection body with respect to the above one swing lever in the longitudinal direction of the guide portion.

Both of the paired swing levers respectively include a guide portion extending in almost the same direction, the connection body is connected with both of the guide portions movably in the longitudinal direction of the guide portions, thereby connecting both of the paired swing levers with each other, and the position change device includes a mechanism for moving the connection body which moves the connection body with respect to both of the paired swing levers in the longitudinal direction of the guide portions.

PREFERRED EMBODIMENTS OF THE INVENTION

Figure 1:
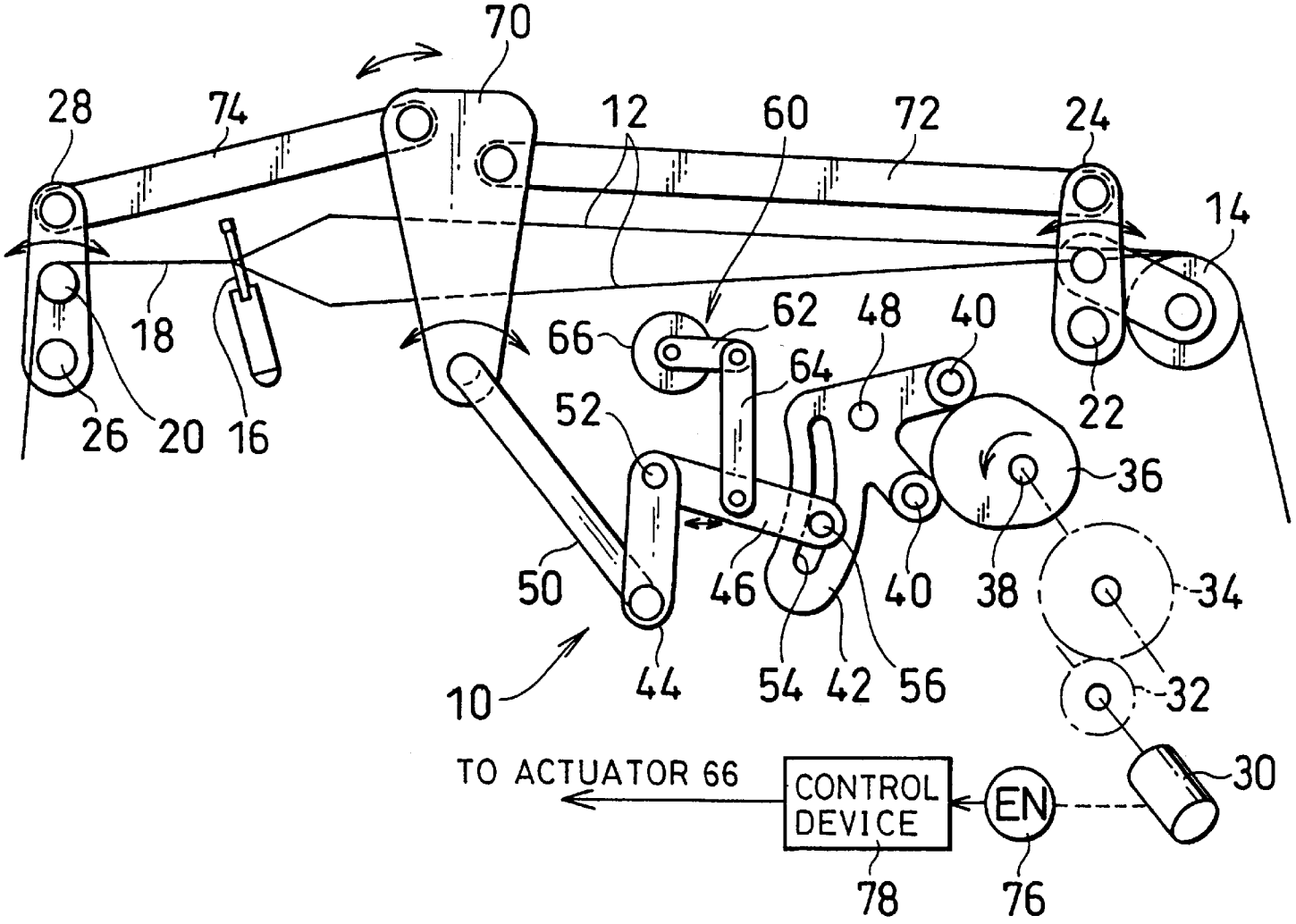
FIG. 1 is a schematic diagram of a pile fabric loom into which a pile forming apparatus according to the invention is incorporated.
Figure 2:
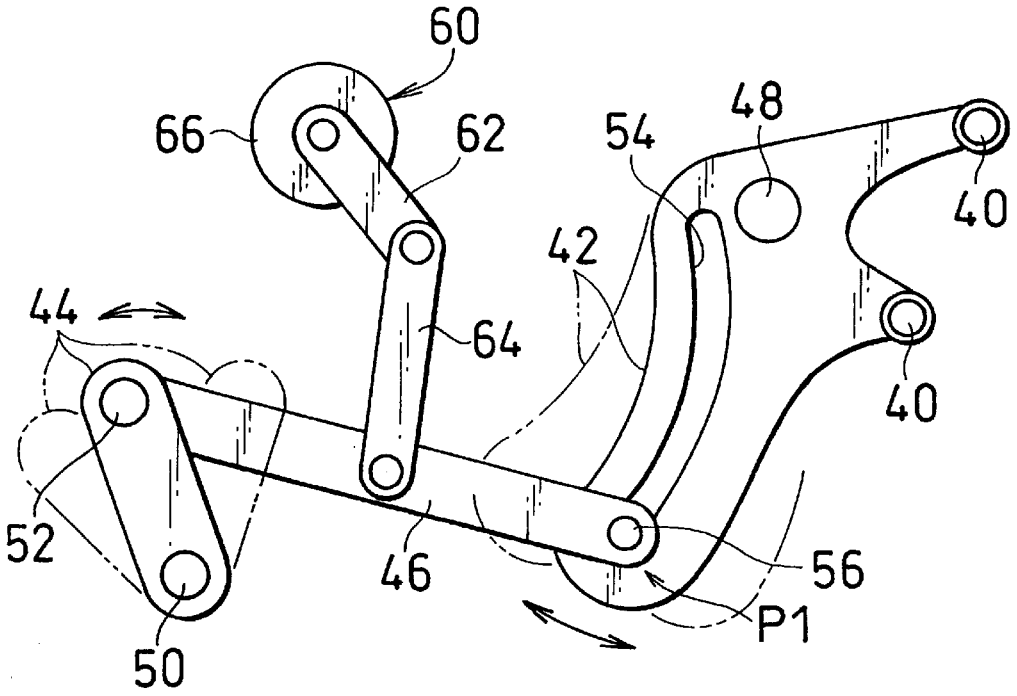
FIG. 2 is a schematic diagram of a transmission mechanism for transmitting the power of a cam to the cloth moving member of the pile forming apparatus shown in FIG. 1.
Figure 3:
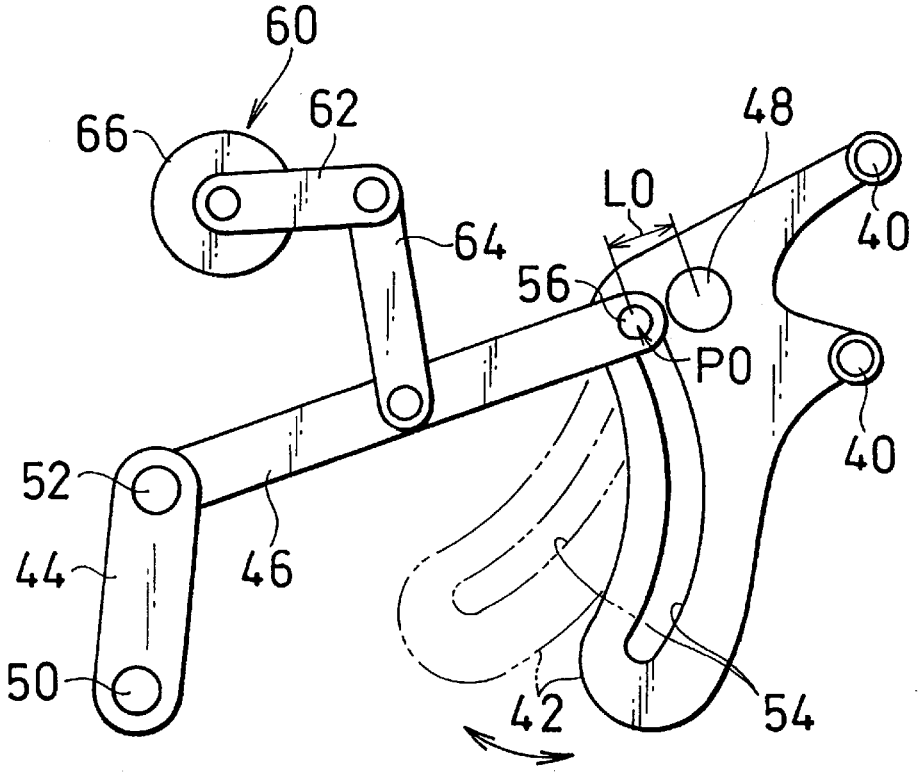
FIG. 3 is a schematic diagram showing the state that in the transmission mechanism shown in FIG. 2, a swing lever is coupled with the uppermost end of a guide portion.

Referring to FIGS. 1, 2 and 3, a pile forming apparatus 10 according to the invention is incorporated into a pile fabric loom of the class wherein a plurality of warp yarns 12 extending from a warp yarn beam (not shown) are guided, via a tension roller 14 and a shed arranged in front of the tension roller 14 (i.e. the downstream side with respect to the warp running direction), to the beating position arranged in front of the shed. Then, in this beating position, a weft yarn is beaten to the cloth fell by a reed 16, thereby weaving those yarns into a woven fabric. The woven fabric 18 or a terry towel is wound on a cloth roller (not shown) through a breast beam 20.

A shed-forming means (not shown) makes warp yarns 12 form a shed in a predetermined shedding position in synchronism with rotation of the principal shaft or main shaft (not shown) of the loom (not shown). The weft yarn is inserted through the shed of warp yarns 12 by means of a weft feeder. The reed 16 is driven in synchronism with rotation of the main shaft of the loom.

The tension roller 14 is fitted to a pair of levers 24 pivotally supported on the frame (not shown) of the loom through both ends of a pivot shaft 22. On the other hand, the breast beam 20 is fitted to a pair of levers 28 pivotally supported on the frame of the loom through both ends of a pivot shaft 26 such that the breast beam can vary the tension applied to warp yarns.

The rotating speed of a principal motor 30 for rotating the main shaft of the loom is reduced by means of a plurality of gears 32 and 34 and is then transmitted to a cam 36. This cam 36 is supported on a revolving shaft 38, which is rotated in synchronism with the main shaft of the loom by means of the rotating shaft 38 rotated by the gear 34.

The outer circumferential surface of the cam 36 constitutes a cam surface, which is in contact with a plurality of cam followers 40 at intervals of a predetermined distance in the circumferential direction. These cam followers 40 are rotatably fitted to a driving side swing lever 42, which is connected with a driven side swing lever 44 with the help of a connection body 46, the swing lever 44 being arranged in front of the swing lever 42 to be at a distance therefrom.

Swing levers 42 and 44 are pivotally supported on the frame of the loom by means of pivot shafts 48 and 50, respectively, and are made to swing about the respective corresponding axes (pivotal axes) of the pivot shafts 48 and 50 in response to rotation of the cam 36. Therefore, the cam 36 and the cam followers 40 function as a positive motion cam mechanism capable of swinging the swing levers 42 and 44 by making use of only rotation of the cam 36 without employing any spring force.

The swing lever 42 includes an arc-shaped guide portion 54, of which the center of curvature is on the axis of a pivot shaft 52 connecting the swing lever 44 with one end of the connection body 46. In the example illustrated in related figures i.e. FIGS. 1 through 3 now referred to, the guide portion 54 is illustrated as an elongated hole extending in the up and down directions, in other word, a hole extending in the longitudinal direction of the swing lever 42. The swing lever 42 is pivotally supported with the pivot shaft 48 on one end side (upper side) with respect to the longitudinal direction of the elongated hole or the guide portion 54. On the other hand, the swing lever 44 is pivotally supported with a pivot shaft 50 on the other end side (lower side) with respect to the longitudinal direction of the elongated hole or the guide portion 54. In FIG. 3, the swing lever 42 indicated with solid lines represents the state thereof in a swing phase or swing position in the fast pick position. At this time, the guide portion 54 corresponds to an arc placing its center on the pivot 52 and having a radius determined by a distance between the pivot 52 and the connection member 56.

In the example illustrated in related figures now referred to, the connection body 46 is constituted as a long link extending in the running direction of the warp yarns 12 (the front and back direction) and is provided at the other end thereof with a connection member 56 displaceably connected with the swing lever 42. The connection body 46 can be swung about the pivot shaft 52. The connection member 56 is fitted into the guide portion 54 movably in the longitudinal direction thereof.

The connection member 56 may be a connection pin having a pivot or a roller capable of revolving about the axis extending widthwise of the pile forming apparatus 10 (i.e. the direction at a right angle with the drawing paper carrying FIG. 1). With this structure, the connection body 46 comes to smoothly move with respect to the swing lever 42.

The position connecting the connection body 46 with the swing lever 42 (in terms of the example as shown, the position of the connection member 56 within the guide portion 54) can be changed by a position change mechanism or device 60. This device 60 includes an actuator 66 and a pair of link levers 62 and 64 which are pivotally connected with each other. The actuator 66 drives these link levers 62 and 64 to make them bend and stretch, thereby changing the position of the connection member 56 within the guide portion 54.

The actuator 66 has functions of changing the position of the connection member 56 within the guide portion and also of holding the connection member 56 in its newly changed position. Such an actuator 66 may be constituted with a rotation source, for instance a servomotor, a rotary solenoid and so forth, which is capable of releasably locking the angular position of rotation.

As shown in FIGS. 1 and 2, if the connection member 56 takes a position other than the top end of the guide portion 54, the swing motion of the swing lever 42 is transmitted to the swing lever 44, and both of the swing levers 42 and 44 are swung in respective ranges as indicated with two-dot chain lines in FIG. 2. The position between the connection member 56 and the swing lever 42 as shown FIGS. 1 and 2 functions as the first position P1 corresponding to the effective lever length, which makes it possible to form piles.

In contrast to this, as shown in FIG. 3, if the connection member 56 takes a position at the top end of the guide portion 54, the swing lever 42 is swung to the position indicated with the two-dot chain line in FIG. 3, but the swing motion of the swing lever 42 can not be transmitted to the swing lever 44. This is because the second position P0 comes on the line connecting the axes of both pivot shafts 48 and 52 with each other and also because the space or distance L0 between both pivot shafts 48 and 56 are made short. The position connecting the connection member 56 with the swing lever 42 as shown in FIG. 3 functions as a second position P0 corresponding to the effective lever length, which is unable to essentially form any pile.

The pivot shaft 50 is a connection rod rotatably supported with the frame of the loom while the swing lever 44 is irrotatably fitted to one end of this connection rod or the pivot shaft 50. Thus, the pivot shaft 50 is angularly reciprocated in response to the swing motion of the driven side swing lever 44.

The angular reciprocating motion of the pivot shaft 50 is transmitted to a driving lever 70 relatively irrotatably fitted to the other end of the pivot shaft 50 and is further transmitted from the driving lever 70 to a lever 24 through a link 72 as well as to a lever 28 through a link 74. With this, the levers 24 and 28 are repetitively swung, whereby the tension roller 14 and the breast beam 20 are repetitively reciprocated in the right and left directions in FIG. 1.

In the example as shown, the lever 28, the link 74 and the breast beam 20 function as a cloth moving mechanism while the lever 24, the link 72 and the tension roller 14 function as a warp moving mechanism. Furthermore, the breast beam 20 and the tension roller 14 function as a cloth moving member and a warp moving member, respectively. Still further, the swing levers 42, 44 and the connection body 46 function as a power transmission mechanism for transmitting the power of the cam to the cloth moving mechanism and the warp moving mechanism as well.

The rotation angle of the main motor 30 is detected by an encoder 76 and the detected signal is supplied to a control device 78, which controls the rotation speed of the actuator 66 by using the input signal from the encoder 76.

When the cam 36 is revolved, the levers 42, 44, 70, 24 and 28 are respectively swung. With these swing motions, the woven fabric 18 and the warp yarns 12 are repetitively reciprocated in the right and left directions of FIG. 1, whereby the cloth fell is repetitively moved from the fast pick position to the loose pick position or vice versa at a predetermined frequency in synchronism with rotation of the main shaft of the loom. With this, the weft yarn is repetitively beaten at a predetermined rate in the fast pick position as well as in the loose pick position and is beaten against the cloth fell when the cloth fell comes to the fast pick position.

As shown in FIGS. 1 and 2, while the pile weaving operation is carried out, the connection body 46 is kept staying in a predetermined position on the way of or at the lowermost end of the guide portion 54 with respect to the longitudinal direction thereof by means of a position change device 60. With this, as the swing levers 42 and 44 are swung with rotation of the cam 36, the cloth fell is repetitively moved from the fast pick position to the loose pick position or vice versa, and the pile is formed by beating the weft yarn against the cloth fell when the cloth fell comes to the fast pick position.

As shown in FIG. 3, while the ordinary cloth weaving operation or border weaving operation is executed, the connection body 46 is held at the uppermost end (the second position P0) of the guide portion 54 by the position change device 60. At this time, the swing motion of the swing lever 42 can not be transmitted to the swing lever 44 so that the pile can not be formed, and the cloth fell is held standing on the fast pick position. However, the position change device 60 is constructed to be operable even if the swing lever 42 is in the swing phase in the fast pick position, so that it can move the connection body 46 under such condition.

In the pile forming apparatus 10, the swing levers 42 and 44 are always connected with each other while the swing lever 42 and the cam mechanism are also always connected with each other. Therefore, the cam 36 comes to receive the load applied to the entire system, for instance, the load applied in the form of the tension given to the warp yarns and the woven fabric, the reaction force caused by beating and so forth. As a result, there is no need to provide such a stopper as was required in the prior art, and the apparatus is not enlarged in the scale.

In the pile forming apparatus 10, while the fulcrums of swing motion of swing levers 42 and 44 (axes of the pivot shafts 48 and 50) are positioned on one side and the other side with respect to the longitudinal direction of the guide portion 54, but they may be positioned on the same side. Also, instead of employing the positive motion cam mechanism, it is possible to employ a negative motion cam mechanism making use of the spring force, a driving mechanism other than the cam mechanism and so forth.

Figure 4:
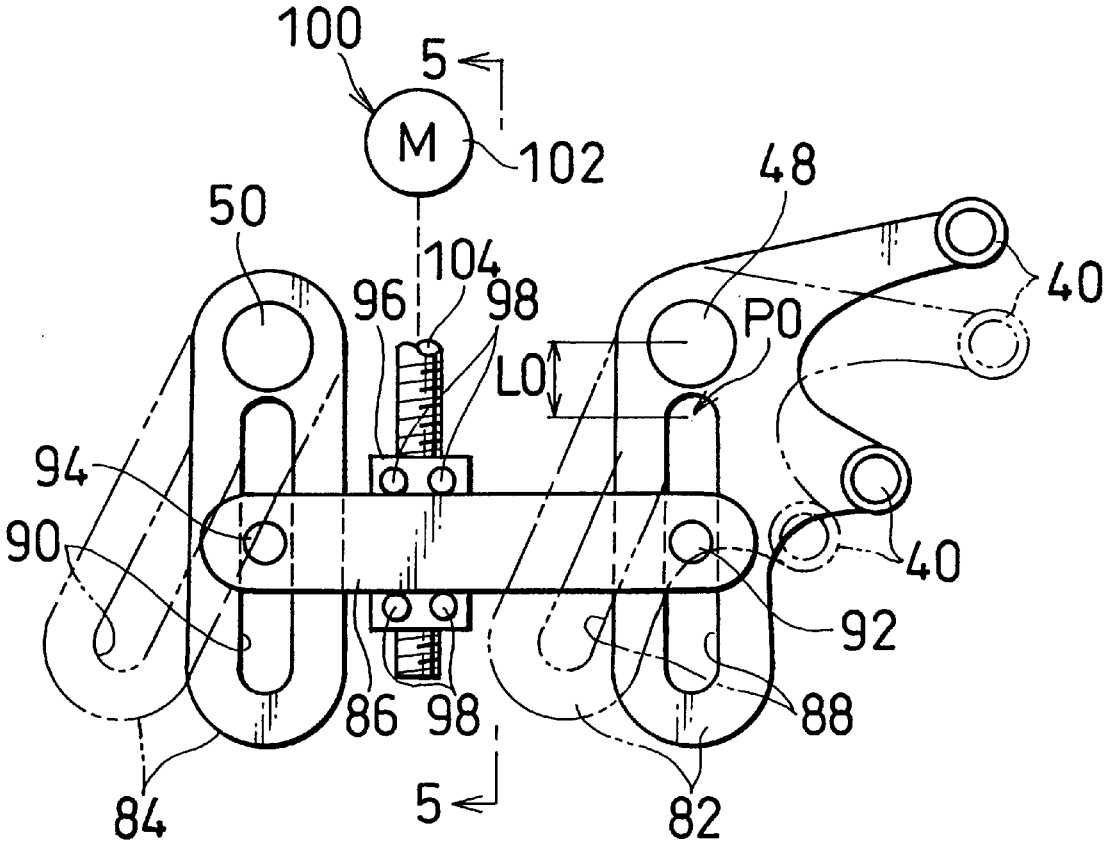
FIG. 4 is a schematic diagram showing another embodiment of a transmission mechanism for transmitting the power of a cam to a cloth moving member.
Figure 5:
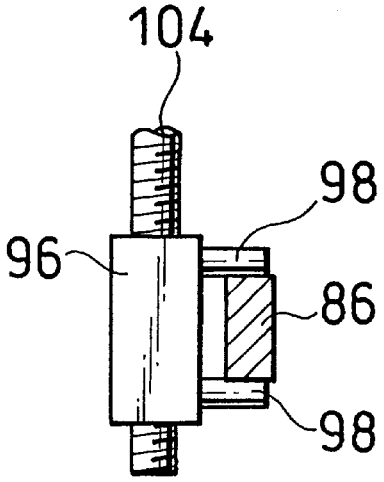
FIG. 5 is a view taken along line 5—5 of FIG. 4.

FIGS. 4 and 5 show a transmission mechanism for transmitting the revolving motion of the cam to the cloth moving mechanism and the warp yarn moving mechanism according to another embodiment of the invention. This transmission mechanism includes a driving side swing lever 82 swung by the cam 36 (FIG. 1), a driven side swing lever 84 swung by the driving side swing lever 82, and a connection body 86 for connecting these swing levers 82 and 84 with each other.

The swing levers 82 and 84 are pivotally supported on the frame of the loom to swing about their pivot shafts 48 and 50, respectively, in response to the rotation of the cam 36.

The swing levers 82 and 84 include guide portions 88 and 90, respectively, which extend in parallel in almost the same directions (i.e. almost vertical directions in the example as shown). These guide portions 88 and 90 are positioned at about the same level and arranged at a certain distance in the front and back directions (i.e. the warp running direction). In the example as illustrated, each of the guide portions 88 and 90 is formed as an elongated hole having about the same length.

The swing levers 82 and 84 are pivotally supported by the pivot shafts 48 and 50, respectively, at each one end (upper end in the example as shown) of elongated holes or the guide portions 88 and 90.

In the example as shown, the connection body 86 is formed as a long link extending in the warp running direction (i.e. the front and back directions) and includes, at its both ends, connection members 92 and 94 which are connected with the guide portions 88 and 90 movably in the longitudinal direction of the guide portion. The connection body 86 is made movable in the longitudinal direction of the guide portions 88 and 90 while the guide portions 88 and 90 regulate the movement of the connection body 86, especially the movement of the connection members 92 and 94 in the longitudinal direction of the guide portions 88 and 90.

The connection body 86 connects the swing levers 82 and 84 with each other such that the distance between two points connecting both swing levers is kept constant, in other words, such that while both of the swing levers 82 and 84 are doing their swing motion, their guide portions 88 and 89 are kept in parallel. The connection members 92 and 94 may be made in the form of a connection pin constituted by a pivot axis or a roller rotatable about the axis line extending widthwise of the pile forming apparatus (i.e. at a right angle with respect to the drawing paper carrying FIG. 4).

The posture of the connection body 86 is regulated to be kept almost horizontal by a posture regulation device 96. With this, the change in posture of the connection body 86 due to the swing motion of both levers 82 and 84 is regulated, and the swing motion by the swing lever 82 is surely transmitted to the swing lever 84.

The posture regulation device 96 holds both sides of the connection body 86 widthwise thereof by means of a plurality of holding means 98 which can revolve about the axis extending widthwise of the pile forming apparatus. With this, the connection body 86 is allowed to smoothly reciprocate almost horizontally, following the swing motion of the swing lever 82.

The holding means 98 may be made in the form of a roller rotatable about the axis extending widthwise of the pile forming apparatus. With this, the connection body 86 can smoothly move with respect to the posture regulation device 96, even though it is held by a plurality of holding means 98.

The posture regulation device 96 can not revolve, but it can be moved vertically together with the connection body 86 by means of a position change device 100. The position change device 100 transmits rotation of an actuator 102 such as a servomotor to a threaded rod 104 engaged with the threaded hole of the connection body 86, thereby rotating the threaded rod 104. The connection body 86 is moved upward by revolving the threaded rod 104 in one direction and is moved downward by revolving the same in the other or opposite direction. Thus, the position connecting both swing levers 82 and 84 with each other by the connection body 86 can be varied by the position change device 100.

Change of the connecting position is preferably executed when both of swing levers 82 and 84 are in a swing phase where both of guide portions 89 and 90 equally extend in the up and down direction as indicated with solid lines in FIG. 4, and more preferably, the above swing phase is made to coincide with the swing phase in the fast pick position.

In the transmission mechanism shown in FIG. 4, when the connection members 92 and 94 take the first position, that is, they are on the way of or at the lowest ends of the guide portions 88 and 90, the swing lever 82 is made to swing in response to rotation of the cam, and this swing motion is subsequently transmitted to the swing lever 94 through the connection body 86. Consequently, the swing levers 82 and 84 are swung as indicated by the two-dot chain lines in FIG. 4.

In contrast to this, when the connection members 92 and 94 take the second position, that is, they are at the uppermost ends of the guide portions 88 and 90, the distance L0 between the pivot shaft 48 and the connection member 92 is made short and the swing lever 82 can swing only in a very narrow or almost ineffective range in response to rotation of the cam. Likewise, the distance between the pivot shaft 50 and the connection member 94 is also made so short that the swing lever 94 can hardly be swung. In the situation like this, the cloth fell is held in the fast pick position.

While the pile weaving operation is carried out, the connection body 86 is held in a predetermined position on the way of or at the lowest ends of the guide portions 88 and 90 in respect of the longitudinal direction thereof by means of the position change device 100, and the cloth fell is repetitively reciprocated between the fast pick position and the loose pick position. The pile is formed when the cloth fell is moved to the fast pick position and the weft is beaten against the cloth fell. The lower the position of the connection body 86 is set in the guide portions 88 and 90, the longer the length of the formed pile is made. It should be noted here that the pile forming apparatus of the invention can be constructed such that the cloth fell is substantially maintained in the fast pick position to the extent that any pile can not be formed, even though the swing lever 84 might be swung a little by the swing motion of the swing lever 82.

During the ordinary cloth weaving or border weaving on the way of the pile weaving operation, the connection body 86 is held in the uppermost end positions of the guide portions 88 and 90 by the position change device 100. At this time, the swing motion of the swing lever 82 is not transmitted to the swing lever 84, so that no pile is formed. At this time, the cloth fell is also kept in the fast pick position.

Similar to the embodiment described previously, in the transmission mechanism shown in FIG. 4, the swing levers 82 and 84 are always connected with each other while the swing lever 82 and the cam mechanism are also always connected with each other. Therefore, the cam mechanism comes to receive the load applied to the entire system, for instance the load in the form of the tension applied to the warp yarns and the woven fabric, the reaction force caused by beating and so forth. As a result, there is no need to additionally provide such a stopper as was required in the prior art, and the scale of the apparatus is not enlarged.

In the transmission mechanism shown in FIG. 4, the fulcrums of swing motion of swing levers 82 and 84 are positioned on the same side, but they may be positioned on the opposite side with respect to the longitudinal direction of the guide portion 88.

Figure 6:
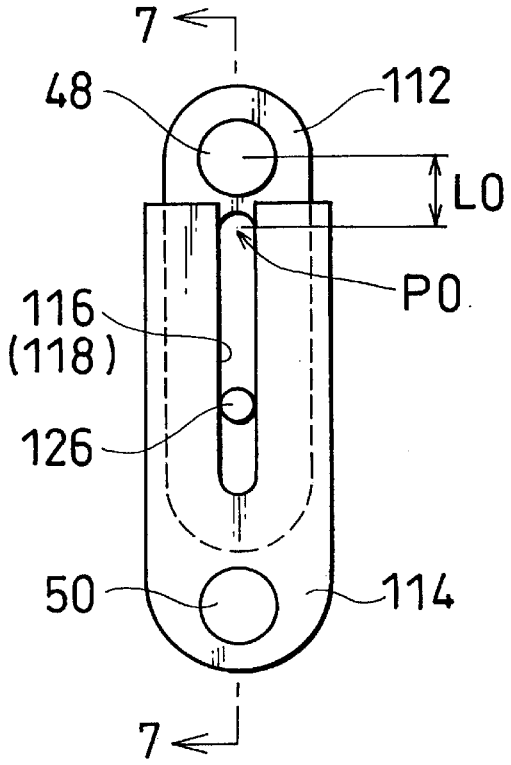
FIG. 6 is a schematic diagram showing still another embodiment of a transmission mechanism for transmitting the power of a cam to a cloth moving member.
Figure 7:
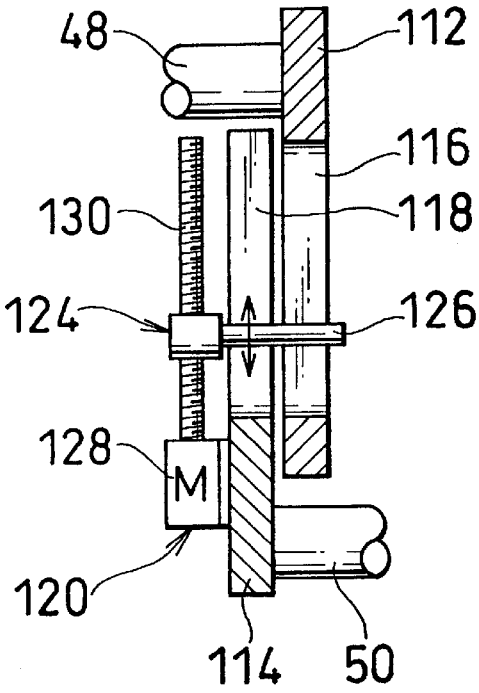
FIG. 7 is a view taken along line 7—7 of FIG. 6.

FIGS. 6 and 7 show a transmission mechanism for transmitting the power of the cam to the cloth moving member and the warp yarn moving member according to still another embodiment of the invention. This transmission mechanism includes a pair of swing levers 112 and 114 in the form of a plate with one laid on top of another in the thickness direction thereof. Swing levers 112 and 114 include guide portions 116 and 118, respectively. These guide portions 116 and 118 are made in the form of an elongated hole extending in almost the same direction.

The swing lever 112 is a driving side swing lever and is pivotally supported by the pivot shaft 48 located near the one end portion of the guide portions 116 and 118 with respect to the longitudinal direction thereof. The swing lever 114 is a driven side swing lever driven in response to the swing motion of the swing lever 112 and is pivotally supported by the pivot shaft 50 located near the other end of the guide portions 116 and 118 with respect to the longitudinal direction thereof.

A connection body 124 connecting both swing levers 112 and 114 with each other includes a connection member 126 slidingly connected with both of guide portions 116 and 118. The connection member 126 may be a connecting pin having a pivot or a roller capable of rotating about the axis extending widthwise of the pile forming apparatus.

The connection body 124 is engaged with a threaded rod 130, which is rotated by a reversible rotary type actuator 128 of a position change device 120, and is moved up and down in response to rotation of the threaded rod 130.

The transmission mechanism shown in FIGS. 6 and 7 functions in the same way as those which are described in connection with FIGS. 1 through 5. That is, the swing motion of the swing lever 112 is transmitted to the swing lever 114, the swing motion of which is, in turn, transmitted to the cloth moving member. In the transmission mechanism as shown in FIGS. 6 and 7, the posture of the connection body 124, especially that of connection member 126 is preferably regulated by the posture regulation device.

In the transmission mechanism as shown in FIGS. 6 and 7, when the connection members 126 takes the first position, that is, on the way of or at the lowest ends of respective guide portions 116 and 118, the swing lever 112 is made to swing in response to rotation of the cam, and this swing motion is subsequently transmitted to the swing lever 114 through the connection body 124, whereby the swing levers 112 and 114 are swung accordingly.

In contrast to this, when the connection members 126 takes the second position, that is, at the uppermost ends of respective guide portions 116 and 118, the distance L0 between the pivot shaft 48 and the connection member 112 is made minimum, so t hat the swing lever 114 is hardly swung. In the situation like this, the cloth fell is held in the fast pick position.

During the pile weaving operation, the connection body 124 is held in a predeter mined position on the way of or at the lowest ends of the guide portions 116 and 118 in respect of the longitudinal direction thereof by means of the position change device 120, and the cloth fell is repetitively moved from the fast pick position to the loose pick position or vice versa. The pile is formed when the cloth fell is moved to the fast pick position and the weft is beaten against that cloth fell. The lower the position o f the connection body 124 is set in the guide portions 116 and 118, the longer the length of the formed pile is made.

During the ordinary cloth weaving or border weaving on the way of the pile weaving operation, the connection body 124 is held in the uppermost end positions of the guide portions 88 and 90 by the position change device 120. At this time, the swing motion of the swing lever 112 is not transmitted to the swing lever 114, so that no pile is formed. At this time, the cloth fell is kept in the fast pick position.

Similar to the embodiments described previously, in the transmission mechanism as shown in FIGS. 6 and 7, the swing levers 112 and 114 are always connected with each other while the swing lever 112 and the cam mechanism are also always connected with each other. Therefore, the cam mechanism comes to receive the load applied to the entire system. As a result, there is no need to provide such a stopper as was required in the prior art, and the scale of the apparatus is not enlarged.

In the embodiment as shown in FIGS. 6 and 7, change of the connecting position between swing levers 112 and 114 by the connection member 126 is preferably executed, as shown in FIG. 6, when both swing levers 112 and 114 are in a swing phase where both guide portions 116 and 118 are in parallel with each other, and more preferably, the above swing phase is made to coincide with the fast pick position.

In the transmission mechanism shown in FIGS. 6 and 7, while the fulcrums of the swing motion of swing levers 112 and 114 are positioned on the same side, but they may be positioned to oppose to each other with respect to the longitudinal direction of the guide portions 116 and 118.

In any of embodiments described above, whenever the connection body is moved to the uppermost position, the cloth fell is kept in the fast pick position, and no pile is formed. However, at the time of executing border weaving operation, the position of the connection body with respect to the swing levers may be changed by means of the position change device to form short piles.

While the invention has been explained by way of a few embodiments according to the invention, the invention should not be limited thereby. For instance, the invention is naturally applicable not only to a pile forming apparatus of the class wherein the woven fabric and warp yarns are simultaneously let off, but also to a pile forming apparatus of the type wherein only the woven fabric is let off. Furthermore, the invention should not be limited by the pile forming apparatus in which swing levers and connection body are connected with each other through elongated holes. For instance, the connection body may be connected with the swing lever through only its one side surface, just like the connection between the swing lever and the slide link as described in the Japanese patent application disclosure (KOKAI) No. H5 (1993)-156546. Therefore, the invention may be changed and modified without departing from the essential gist thereof.

What is claimed is:

1. A cloth moving type pile forming apparatus for forming piles by changing the relative distance between the beating position of a reed and a woven fabric fell of a woven fabric comprising:

a driving mechanism adapted to be operated in synchronism with rotation of the main shaft of a loom;

a cloth moving device for moving the woven fabric fell with respect to the reed;

a transmission mechanism having a pair of swing levers which are connected with each other by a connection body, one of said paired swing levers being driven by said driving mechanism and the other being coupled with said cloth moving device; and a position change device for changing the connecting position between at least one of said paired swing levers and said connection body, from at least one of first positions corresponding to an effective lever length enabling piles to be formed, to a second position corresponding to the effective lever length being unable to form any pile, or vice versa according to a weaving plan or design.

2. An apparatus as claimed in claim 1, wherein said position change device includes means for changing the connecting position between at least one of said paired swing levers and said connection body to a first position selected from a plurality of available first positions.

3. An apparatus as claimed in claim 1, wherein said driving mechanism includes a positive motion cam mechanism.

4. An apparatus as claimed in claim 1, wherein one of said paired swing levers includes a guide portion extending in one direction, said connection body is connected with said guide portion movably in the longitudinal direction of said guide portion and is also pivotally connected with the other of said paired swing levers, thereby connecting both of said swing levers together, and said position change device includes a mechanism for moving the connection body with respect to said one swing lever in the longitudinal direction of said guide portion.

5. An apparatus as claimed in claim 1, wherein each of said paired swing levers include a guide portion extending in almost the same direction, said connection body is connected with both of said guide portions movably in the longitudinal direction of said guide portions, thereby connecting both of said paired swing levers together, and said position change device includes a mechanism for moving said connection body with respect to both of said paired swing levers in the longitudinal direction of said guide portions.

* * * * *

UNITED STATES PATENT AND TRADEMARK OFFICE

CERTIFICATE OF CORRECTION

PATENT NO. : 6,186,187 B1
DATED : February 13, 2001
INVENTOR(S) : A. Nakada

It is certified that error appears in the above-identified patent and that said Letters Patent is hereby corrected as shown below:

Item [54], Title,
"CLOTH MOVING TYPE PILE FORMING APPARATUS" should read
-- PILE FORMING APPARATUS OF CLOTH MOVING TYPE --

Column 1,
Lines 1-2, "CLOTH MOVING TYPE PILE FORMING APPARATUS" should read
-- PILE FORMING APPARATUS OF CLOTH MOVING TYPE --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*